United States Patent [19]

Berreth

[11] 3,962,114

[45] June 8, 1976

[54] METHOD FOR SOLIDIFYING LIQUID RADIOACTIVE WASTES

[75] Inventor: Julius R. Berreth, Idaho Falls, Idaho

[73] Assignee: The United States of America as represented by the United States Energy Research and Development Administration, Washington, D.C.

[22] Filed: Apr. 11, 1975

[21] Appl. No.: 567,340

[52] U.S. Cl. ..... 252/301.1 W

[51] Int. Cl.[2] ..... G21F 9/08

[58] Field of Search ..... 252/301.1 W

[56] References Cited

UNITED STATES PATENTS

| | | | |
|---|---|---|---|
| 2,838,368 | 6/1958 | Boyer et al. | 423/3 |
| 3,006,859 | 10/1961 | Allemann et al. | 252/301.1 W |
| 3,862,296 | 1/1975 | Dotson et al. | 423/251 |

OTHER PUBLICATIONS

Kirk–Othmer *Encyclopedia of Chemical Technology* Interscience Publishers, New York, 1970, vol. 21, pp. 38–39.

Chem. Abstracts, vol. 77, No. 7926 of McElroy et al., "Waste Solidification Program . . . Prototypes."

*Primary Examiner*—Benjamin R. Padgett
*Assistant Examiner*—Deborah L. Kyle
*Attorney, Agent, or Firm*—Dean E. Carlson; Arthur A. Churm; James W. Weinberger

[57] ABSTRACT

The quantity of nitrous oxides produced during the solidification of liquid radioactive wastes containing nitrates and nitrites can be substantially reduced by the addition to the wastes of a stoichiometric amount of urea which, upon heating, destroys the nitrates and nitrites, liberating nontoxic $N_2$, $CO_2$ and $NH_3$.

5 Claims, No Drawings

METHOD FOR SOLIDIFYING LIQUID RADIOACTIVE WASTES

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

The chemical reprocessing of spent nuclear reactor fuel elements to recover the unburned nuclear reactor fuel material generates large volumes of aqueous solutions containing radioactive wastes. In addition to the large volumes produced, the aqueous waste solutions are extremely corrosive and present difficult problems in their handling and storage. Since it is necessary to store these radioactive wastes for extremely long periods of time to permit decay of the highly radioactive fission products included in the wastes, the aqueous wastes are converted to a solid form which, in addition to occupying less volume than the corresponding liquid wastes, is less corrosive and poses less difficult problems in handling and long-term storage. These aqueous radioactive waste solutions can be converted to solid form by spray solidification, fluidized-bed calcination, pot calcination or by heating to dryness and sintering the resulting solid.

Many of these radioactive waste solutions contain substantial quantities of nitrates and nitrites, generally as sodium nitrate. The formation of solids by any of the aforementioned methods from waste solutions containing nitrates and nitrites results in the formation of large quantities of noxious $NO_x$ gases.

At the present time these noxious gases are released to the atmosphere along with the off-gas from the solidification process. This disposal method is obviously undesirable since the nitrous oxides are pollutants in their own right and act as initiators of complex photochemical reactions with hydrocarbons. Some attempts at control are being made such as by passing the off-gas through separators where the nitrous oxides are removed from the off-gas by sorption on liquids or solids, thermal reduction by burning in a fuel-rich flame or by vapor-phase reaction with other compounds. The off-gas may also be contacted with a catalyst which will reduce the nitrogen oxides with or without the addition of a reducing gas.

None of the above alternatives is completely satisfactory in that problems exist with any of the suggestions; for example, the sorption liquids or solids must be disposed of or recharged for further use, while catalysts have a tendency to become poisoned and lose their efficiency.

SUMMARY OF THE INVENTION

An improvement has been made in the method for solidifying liquid radioactive waste solutions containing nitrates and nitrites by heating the solution to dryness which suppresses the evolution of noxious nitrogen oxides, by adding urea to the waste solution before the solution is heated, so that upon heating the urea reacts with the nitrates and nitrites present in the solution to evolve non-noxious elemental nitrogen, carbon dioxide and ammonia gas.

One advantage of the method of this invention is that the addition of urea does not add any additional materials to the solids being formed from the waste solution for which expensive additional solid waste storage facilities must be provided.

It is therefore one object of the invention to provide a process which suppresses the evolution of noxious nitrogen oxides during the solidification of liquid radioactive wastes containing nitrates and nitrites.

It is the other object of the invention to provide a process for eliminating the evolution of noxious nitrogen oxides during the solidification of liquid radioactive wastes containing nitrates and nitrites which does not add to the bulk of the final solidified waste product.

DETAILED DESCRIPTION OF THE PREFERRED EMBODIMENT

These and other objects of the invention for suppressing the evolution of noxious nitrogen oxides during the solidification by heating of liquid radioactive wastes containing nitrates and nitrites may be met by adding a slight excess of a stoichiometric amount of urea relative to the nitrates and nitrites present to the liquid waste, heating the waste containing the urea to at least about 130°C. while bubbling carbon dioxide through the solution whereby the urea reacts with the nitrates and nitrites present in the solution, evolving elemental nitrogen, carbon dioxide and ammonia gas.

The amount of urea to be added to the liquid radioactive waste is dependent upon the quantity of nitrates and nitrites present in the solution. Thus, while one mole of urea will react with four moles of nitrate, one mole of urea will only react with two moles of nitrites, which are generally present as the sodium salts. In addition, it is preferred that a slight excess of the stoichiometric amount be added to the solution to ensure a complete reaction between the urea and the nitrates and nitrites in order to prevent evolution of any nitrogen oxides.

After addition of the urea to the waste solution, the solution should be heated to at least from about 130°C. to about 180°C. to ensure complete reaction between the urea and the nitrates and nitrites present.

It is preferred, but not required, that carbon dioxide be bubbled through the solution to ensure that the reaction goes to completion and to sweep the evolved gases from the waste solution as they are formed.

The process of this invention is particularly useful for the destruction of nitrates and nitrites contained in neutralized and basic solutions. The process may also be useful to a lesser extent with acidic waste solutions where some destruction of the urea may take place before reaction by the urea with the nitrates and nitrites is complete.

The method of this invention for suppressing the evolution of nitrogen oxides can be used with several different methods for the solidification of liquid radioactive wastes. For example, the method can be used with the pot calcination process. In this process, a slight excess of the stoichiometric amount of urea relative to the nitrates and nitrites present is added to the waste solution and the solution is heated to from about 130° to about 180°C. while carbon dioxide may or may not be bubbled through the waste solution. After the solution has been heated to dryness, with the evolution of elemental nitrogen, carbon dioxide and ammonia, the remaining solid is heated to from about 500° to about 700°C. to calcine the solid and prepare it for storage.

The method may also be used in the fluidized-bed calcination process, where the liquid radioactive waste is sprayed onto a fluidized-bed calciner at a temperature of from about 400° to about 600°C. wherein the urea reacts with the nitrates and nitrites present to evolve elemental nitrogen, carbon dioxide and ammonia and suppress the formation of nitrogen oxides. An advantage of the use of this method with fluidized-bed calciners is that the destruction of the nitrates and nitrites by the urea with the addition of proper additives such as hydrated alumina may prevent harmful agglomeration of sodium nitrate and sodium nitrite in the fluidized bed.

The following examples are given as illustrative of the method of this invention and are not to be taken as limiting the scope of the invention, which shall be defined by the claims appended hereto.

EXAMPLE I

An experiment on the destruction of nitrates and nitrites was tried using a simulated neutralized Purex waste solution having the following composition:

| Constituent | Molarity |
|---|---|
| $NaNO_3$ | 3.0 |
| $NaNO_2$ | 1.0 |
| NaOH | 0.3 |
| $Fe(OH)_3$ | 0.2 |
| $Na_2SO_4$ | 0.2 |
| $NaAlO_2$ | 0.6 |
| $Na_2CO_3$ | 0.3 |
| $MnO_2$ | 0.2 |
| NaF | 0.02 |
| $Hg(NO_3)$ | 0.001 |
| $Na_3PO_4$ | 0.01 |
| NaCl | 0.01 |
| NaI | 0.001 |
| $Mg(OH)_2$ | 0.01 |
| $Ca(OH)_2$ | 0.003 |

A stoichiometric amount of urea relative to the sodium nitrate and sodium nitrite present was added to the waste solution, which is 4 Molar in nitrate-nitrite and 6 Molar in sodium. The solution was heated to dryness at temperatures not above 180°C. with the evolution of $N_2$ and $NH_3$. Heating of the solid to 600°C. liberated very minimal amounts of nitrogen oxides. Untreated solids heated to this temperature liberate copious amounts of nitrogen oxides. It was noted that the solid material was not as soluble as untreated dried waste solids.

EXAMPLE II

A stoichiometric amount of urea relative to the nitrate and nitrite present was added to a neutralized Purex waste similar in composition to that previously described, except that it had been dried to remove the water. The urea-waste mixture was rewetted and heated. After the water evaporated, the mixture boiled at a temperature of 108° to 112°C. with the evolution of $N_2$ and $HH_3$. This continued until the urea was destroyed and the temperature of the mixture rose gradually to heater temperature of about 180°C. Upon heating in a tube furnace, the mixture melted at about 320°C with no evolution of nitrogen oxides. Further heating of the mixture up to 700°C. produced no evolution of nitrogen oxides.

As can be seen from the previous examples, the addition of stoichiometric amounts of urea to radioactive waste solutions containing nitrates and nitrites, permits the solidification of these solutions to more easily storable solids without the liberation of noxious nitrogen oxides. It was noted that the solid material was not as soluble as untreated dried waste solids.

The embodiments of the invention in which an exclusive property or privilege is claimed are defined as follows:

1. In the method of solidifying liquid radioactive wastes by heating the wastes to dryness, wherein the wastes contain nitrates and nitrites which upon heating evolve noxious nitrogen oxides, the improvement comprising: adding urea to the waste solution before heating the waste solution, whereby upon heating the solution to between 130° and 180°C the urea reacts with the nitrates and nitrites present in the solution to evolve $N_2$, $CO_2$ and $NH_3$ gases.

2. The method of claim 1 wherein at least a stoichiometric amount of urea relative to the nitrates and nitrites present is added to the solution.

3. The method of claim 2 wherein the solution is heated to 180°C. whereby the reaction between the urea and the nitrates and nitrites is completed.

4. The method of claim 3 wherein the waste solution containing the urea is heated by the pot calcination process.

5. The method of claim 4 wherein $CO_2$ is bubbled through the solution until it is heated to dryness.

* * * * *